United States Patent [19]

Downes

[11] Patent Number: 4,776,253

[45] Date of Patent: Oct. 11, 1988

[54] CONTROL APPARATUS FOR ELECTRONIC MUSICAL INSTRUMENT

[76] Inventor: Patrick G. Downes, 32 Club Rd., Pasadena, Calif. 91105

[21] Appl. No.: 869,205

[22] Filed: May 30, 1986

[51] Int. Cl.[4] ..... G10H 1/00

[52] U.S. Cl. ..... 84/1.01; 84/1.03; 446/242

[58] Field of Search ..... 84/1.01, 1.03, 1.27, 84/DIG. 12, 1.11, 1.19, 1.24; 446/242, 247

[56] References Cited

U.S. PATENT DOCUMENTS

| | | | |
|---|---|---|---|
| 1,661,058 | 2/1928 | Theremin . | |
| 3,226,704 | 7/1963 | Petrash . | |
| 3,559,492 | 1/1967 | Erdley . | |
| 3,625,068 | 8/1970 | Kelly . | |
| 4,027,535 | 6/1977 | Swanson . | |
| 4,099,437 | 7/1978 | Stavrou et al. | 84/1.01 |
| 4,213,343 | 7/1980 | Hoffmann . | |
| 4,241,636 | 12/1980 | Long | 84/1.01 |
| 4,341,140 | 7/1982 | Ishida | 84/1.27 |
| 4,403,536 | 9/1983 | Weil, Jr. et al. | 84/1.01 |
| 4,412,470 | 11/1983 | Jones | 84/1.01 |
| 4,430,917 | 2/1984 | Pepper, Jr. | 84/1.01 |
| 4,483,229 | 11/1984 | Tsukamoto et al. | 84/1.01 |
| 4,484,506 | 11/1984 | Sato | 84/1.01 |
| 4,510,802 | 4/1985 | Peters . | |
| 4,568,303 | 2/1986 | Brown | 446/242 |
| 4,662,260 | 5/1987 | Rumsey | 84/1.01 |

OTHER PUBLICATIONS

MIDI Musical Instrument Digital Interface Specification 1.0, the International MIDI Association, 1985 (incorporated by reference).

*Primary Examiner*—S. J. Witkowski
*Attorney, Agent, or Firm*—Lyon & Lyon

[57] ABSTRACT

In a preferred embodiment of the invention, a control unit which is freely moveable in space is equipped with three sensors to measure motion (e.g. velocity, acceleration, or the time derivative of acceleration) along three substantially orthogonal axes. The sensors may be meter movements configured to output motion signals indicative of their movement in free space, which signals are amplified, digitized, processed by a microprocessor to detect relative minima and maxima. Processed motion signals are converted to standard MIDI control signals for controlling an electronic musical instrument.

36 Claims, 4 Drawing Sheets

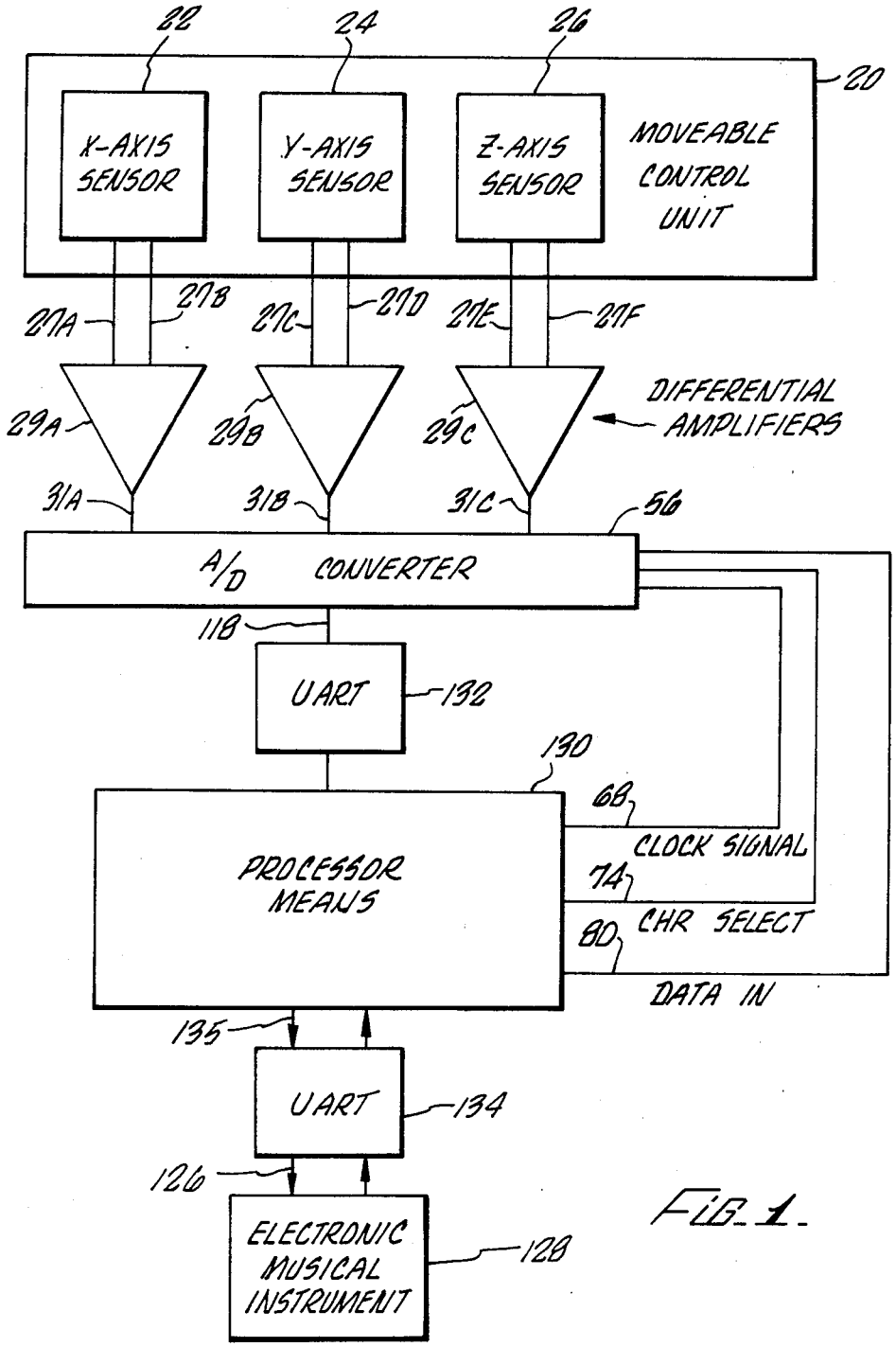
FIG. 1.
FIG. 5.
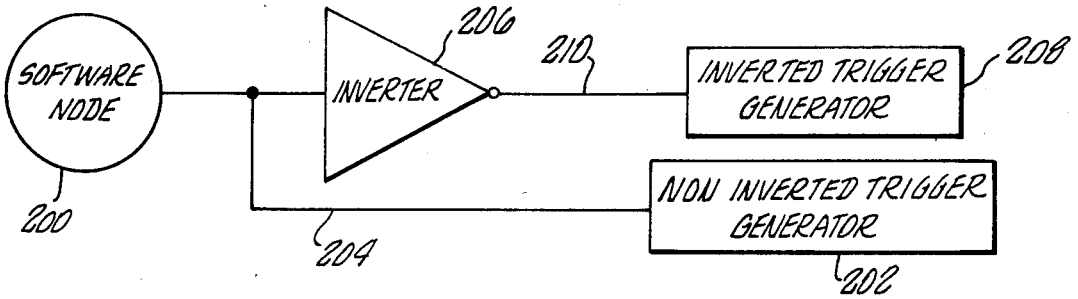

CONTROL APPARATUS FOR ELECTRONIC MUSICAL INSTRUMENT

FIELD OF THE INVENTION

The field of the present invention is devices for controlling electronic musical instruments.

BACKGROUND

Recent advances in electronic technology have lead to the development of a series of entirely new musical instruments. Electronic organs, music synthesizers, digital sampling machines and drum machines, are but a few members of the new generation of electronic musical instruments. Although tremendous advances have occured in the sounds that can be generated with these new instruments, very few advances have occûred in the interface between the human musician and the electronic musical instrument.

The most common interface between the electronic musical instrument and the human musician is based upon the piano keyboard. Some drum machines allow triggering to be performed in the traditional manner, by striking a sensor plate with a stick to generate a trigger signal which causes the drum machine to generate drum-like sounds. While these methods of the prior art achieve their goal of allowing an electronic musical instrument to be triggered, they do not always provide the flexibility which the musician may require. Accordingly, there is a need for a new light weight non-keyboard based apparatus for generating electronic musical instrument control signals with which an electronic musical instrument may be controlled. Accordingly, a control apparatus for an electronic musical instrument which provides a new control interface for electronic musical instruments would be desirable.

SUMMARY OF THE INVENTION

The present invention is directed to an apparatus for generating control signals having a wide dynamic range for use in controlling an electronic musical instrument. To this end, a control unit is provided with at least one sensor for measuring the linear or rotational velocity, acceleration, or time-derivative of acceleration along or about at least one axis of the control unit and circuitry to provide at least one set of output signals. The output signals are processed by signal processing means and converted into control signals responsive to linear or rotational velocity, acceleration, or time-derivative of acceleration, along or about at least one axis of the control unit, which may be used to control an electronic musical instrument.

Accordingly, it is an object of the present invention to provide an apparatus for controlling an electronic musical instrument, employing a control unit having at least one sensor for measuring the velocity, acceleration, or time-derivative of acceleration along or about at least one axis of the control unit, and including circuitry and signal processing means for generating control signals responsive to linear or rotational velocity, acceleration, or time-derivative of acceleration which may be used to control an electronic musical instrument. Other and further objects and advantages will appear hereinafter.

BRIEF DESCRIPTION OF THE DRAWINGS

FIG. 1 is a block diagram of a system employing the present invention.

FIG. 5 is a diagram showing the flow of information in a portion of the software.

DETAILED DESCRIPTION OF THE PREFERRED EMBODIMENT

Figure 2:
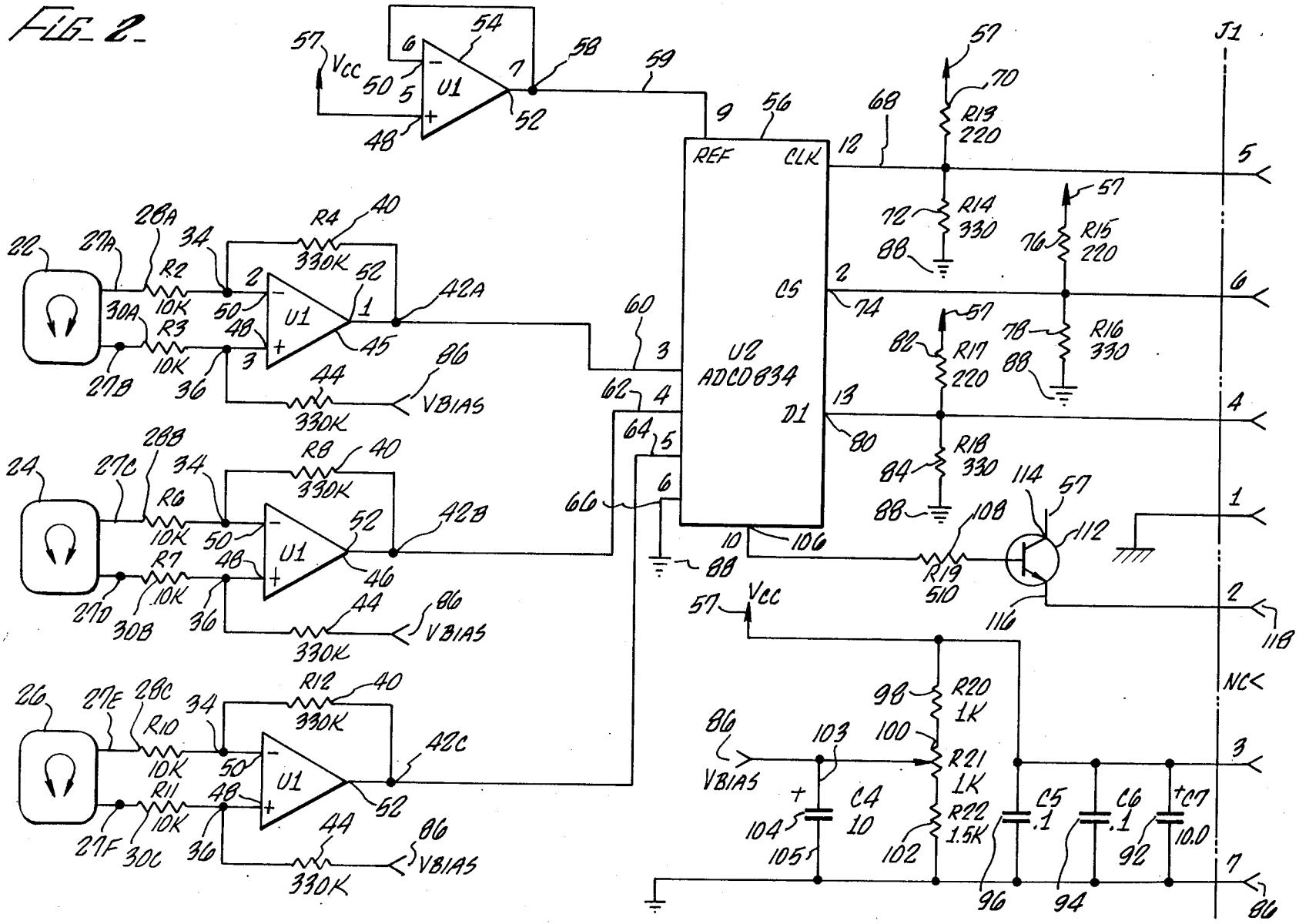
FIG. 2 is an electrical schematic diagram depicting sensors and circuitry associated therewith.

FIG. 1 illustrates a block diagram of a preferred embodiment of the entire system illustrating moveable control unit 20, which may be freely moveable in space, containing three sensors 22, (x-axis sensor), 24 (y-axis sensor), 26 (z-axis sensor), processor means 130, and electronic musical instrument 128.

A preferred embodiment of the present invention includes at least one moveable control unit 20 (hereinafter sometimes referred to as a "control unit") which may be hand-held, although any number of control units could be used. In a preferred embodiment, each control unit includes three sensors 22, 24 and 26 which sense the time-derivative of rotational acceleration about three substantially orthogonal axes, although other types of sensors may be used such as sensors which detect the time-derivative of linear acceleration, sensors which detect linear or rotational acceleration, and sensors (hereinafter sometimes referred to as velocitimeters) such as rate gyros, which may be used to detect rotational or linear velocity. The sensors 22, 24 and 26 are mounted within control unit 20 and control unit 20 has at least one sensor. The use of three sensors 22, 24, 26 allows the time derivative of rotational acceleration of control unit 20 about three substantially orthogonal axes to be detected and processed to create control signals for controlling one or more electronic musical instruments 128. Although sensors 22, 24 and 26 of a preferred embodiment are mounted on control unit 20 which, in turn, is mounted within a cylindrical metal tube in a preferred embodiment, it is possible to mount one or more such sensors in other ways so as to allow various parts of a human body or other moving objects to be attached to control unit 20 and thus generate control signals to an electronic musical instrument—for example, control unit 20 could be strapped with elastic bands to a person's arms or legs to generate control signals which are related to arm or leg movement for controlling one or more electronic musical instruments 128. Sensors 22, 24 and 26 are sometimes referred to herein as x-axis sensor 22, y-axis sensor 24, and z-axis sensor 26. Each of the sensors has a static impedance of approximately 500 ohms but may be replaced with sensors with other impedance.

Sensors 22, 24 and 26 generate motion signals carried on lines 27A–F in response to undergoing changes in acceleration. Motion signals on lines 27A–F are input to differential amplifiers 29A–C where the signals from sensors 22, 24 and 26 are differentially amplified in the conventional manner well-known in the art and output on lines 31A–C. The outputs of differential amplifiers 29A–C on lines 31A–C are input to A/D converter 56 which converts the analog motion signals on lines 31A–C to a digital buffered output data signal on line 118. Buffered output data signal on line 118 is in turn transmitted to a processor means 130 via UART 132, as is well known in the art and is subsequently processed by processor means 130 which generates control signals on line 135 to control the electronic musical instrument 128. Control signals on line 135 are transmitted to electronic musical instrument 128 via UART 134 and over output line 126 in a conventional manner well known in the art and described in more detail in the MIDI (Musicial Instrument Digital Interface) Specificatin 1.0, hereby incorporated by reference.

Turning to FIG. 2, the circuitry used to convert the motion signals on lines 27A–F generated by sensors 22, 24 and 26 to a digital buffered output data signal on line 118 used by processor means 130 to generate control signals on line 135 is depicted. Sensors 22, 24 and 26 each have a first lead 27A, 27C and 27E respectively and a second lead 27B, 27D and 27F respectively. Each lead 27A, 27C and 27E is electrically connected to a 10K ohm resistor 28A–C which may be rated at one quarter watt, which is in turn connected to node 34. Similarly each lead 27B, 27D and 27F is electrically connected to a 10K ohm resistor 30A–C which may be rated at one quater watt, which is in turn connected to node 36.

Connected to each node 34 is a first lead of a 330K ohm resistor 40 which may be rated at ¼ watt. A second lead of resistor 40 is also connected at node 42A–C. Connected to each node 36 is a first lead of a 330K ohm resistor 44 which may be rated at ¼ watt. A second lead of each resistor 44 is connected to a bias voltage source 86 set at approximately 1.8 DC volts. Operational amplifiers 45, 46 and 47 are associated with each sensor 22, 24 and 26 in a differential amplifier configuration, as is well known in the art. A Model TLC-274 Quad Operational Amplifier may be utilized to provide four such operational amplifiers and is presently available from Texas Instruments Incorporated, although any standard operational amplifier would work. The non-inverting input line 48 of each of operational amplifiers 45, 46 and 47 is attached to each corresponding node 36. The inverting input on line 50 of each of operational amplifiers 45, 46 and 47 is attached to each corresponding node 34. The output line 52 of each of operational amplifiers 45, 46 and 47 is attached at each corresponding node 42A–C.

The remaining operational amplifier 54 of the TLC-274 referred to above, may be used to provide a reference voltage for an A/D converter 56. This is accomplished by connecting the inverting input 50 of operational amplifier 54 to its output 52 at node 58 and then connecting the noninverting input 48 of operational amplifier 54 to a DC voltage source 57 of approximately 5 volts in a voltage follower configuration. The voltage available at node 58 is available as a reference voltage for A/D converter 56 and is connected to A/D converter 56 via line 59 which is attached to the reference voltage input of A/D converter 56. A/D converter 56 may be a National Semiconductor Model ADC 0834 4-channel 8-bit serial input/output analog digital converter with multiplexer options. Channel 0 input line 60 of A/D converter 56 is connected to node 42A. Channel 1 input line 62 of A/D converter 56 is connected to node 42B. Channel 2 input line 64 of A/D converter 56 is connected to node 42C. Channel 3 input line 66 of A/D converter 56 is not used and is tied to ground 88. A clock signal on line 68 is provided for A/D converter 56 from processor means 130 and is terminated close to A/D converter 56 via a 220 ohm resistor 70 to DC voltage source 57 and via a 330 ohm resistor 72 to ground 88. The clock signal on line 68 consists of a 400 kilohertz square wave signal. Clocking circuitry is well-known in the art and thus is not further disclosed herein. A chip select signal on line 74 is provided to A/D converter 56 from processor means 130 and is terminated close to A/D converter 56 via a 220 ohm resistor 76 to DC voltage source 57 and via a 330 ohm resistor 78 to ground 88. Chip select circuitry is well-known in the art and thus is not further disclosed herein. A data-in signal on line 80 is provided to A/D converter 56 from processor means 130 and is terminated close to A/D converter 56 via a 220 ohm resistor 82 to DC voltage source 57 and via a 330 ohm resistor 84 to ground 88.

Data-in signal on line 80 contains a signal consisting of binary information from processor means 130 which selects from which channel of A/D converter 56 a signal will be sent to processor means 130 via buffered output data signal on line 118. This process is carried out in a conventional manner well known in the art and thus is not further disclosed herein.

The voltage divider circuit is connected to ground 82 and DC voltage source 57 and generates its output, bias voltage source 86, with respect to these voltages. Capacitors 92, 94 and 96 are connected in parallel between DC voltage source 57 and ground 88. Capacitor 92 is a 10 microfarad electrolytic capacitor, capacitors 94 and 96 are 0.1 microfarad disc capacitors used for decoupling, as is well known in the art. Resistor 98, variable resistor 100, and resistor 102 form a voltage divider between DC voltage source 57 and ground 88, as is well-known in the art, to provide bias voltage 86. Resistor 98 is a 1K ohm resistor, resistor 100 is a 1K ohm variable resistor, resistor 102 is a 1.5K ohm resistor. Connected to the center tap of variable resistor 100 is the positive lead 103 of a 10 microfarad electrolytic capacitor 104. Available at that positive lead is bias voltage source 86. The negative lead 105 of electrolytic capacitor 104 is attached to ground 88. Variable resistor 100 is adjusted to set the voltage level of bias voltage 86. Other means are well-known in the art for generating bias voltages.

An output data signal on line 106 is provided from A/D converter 56 and consists of binary data bytes ranging in value from hexadecimal "00" to hexadecimal "FF" responsive to movement of sensors 22, 24 and 26, thus resulting in an output data signal having a wide dynamic range. The signal passes from A/D converter 56 through 510 ohm resistor 108 and into the base 110 of transistor 112 configured as an emitter-follower signal buffer, as is well-known in the art. Transistor 112 is a type 2N3906 NPN transitor. The collector 114 of transistor 112 is connected to DC voltage source 57. The emitter 116 of transistor 112 is connected to line 118 which carries the buffered output data signal to processor means 130 via UART 132 as is well known in the art and thus not discussed further herein.

Adjustment of the bias voltage 86 is performed so as to set the steady state output (corresponding to no movement of sensors 22, 24 and 26) of A/D converter 56 channels 0, 1 and 2 to a binary value of approximately "1000 0000" (hexadecimal "80") which is a value half way between the minimum possible digital output value of hexadecimal "00". and the maximum possible digital output value of hexadecimal "FF". Adjustment of the bias voltage 86 may be carried out by adjusting variable resistor 100 while monitoring buffered output data signal on line 118. During adjustment, sensors 22, 24 and 26 must not be undergoing acceleration or changes of acceleration. This choice of adjustment is convenient for the signal processing method utilized in a preferred embodiment disclosed herein, however, it is not required and those skilled in the art will readily see that other signal processing techniques might be employed utilizing different bias voltage settings.

In a preferred embodiment of the invention, small 100 to 500 microampere current measuring analog meter movements are used for x-axis, y-axis and z-axis sensors 22, 24 and 26, although any such meter could be used. A meter movement typical of the one used in the preferred embodiment is presently available from the Shogyo Co. These meter movements are used as sensors. Although such meter movements are typically used as display devices for current-derived information, when the meter movements are moved, signals containing varying levels of current and voltage may be generated on their leads 27A–F, herein referred to as motion signals. In a preferred embodiment, a differential amplifier arrangement is used to amplify the voltage of the motion signal for later conversion to control signals by A/D converter 56 and processor means 130. These sensors should be and are critically damped so that the amplitude of oscillation following activation of the sensor by changing the acceleratin of the sensor will decrease quickly. Methods for generating control signals from sensors 22, 24 and 26 are discussed below. Sensors 22, 24 and 26 are directly mounted on a circuit board containing operational amplifiers 45, 46 and 47 as well as A/D converter 56.

Figure 3:
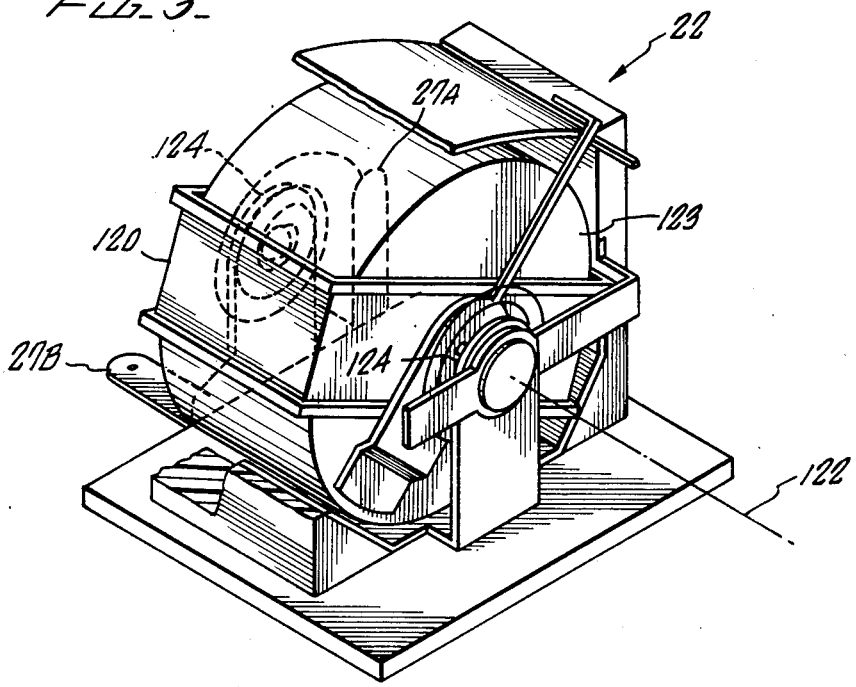
FIG. 3 is a perspective view of a sensor used in a preferred embodiment of the present invention.

Turning to FIG. 3, the meter movements used as sensors 22, 24 and 26 of a preferred embodiment are identical, although there is no requirement that they be so. Referring, for example, to x-axis sensor 22, it has a moving coil 120 which rotates on bearing axis 122 about permanent magnet 123. Biasing means 124 mounted coaxial with bearing axis 122 is provided to bias moving coil 120 toward a rest position about bearing axis 122. As moving coil 120 moves with respect to permanent magnet 123 a motion signal is generated in leads 27A and 27B (disclosed with reference to FIG. 1).

It has been found that the meter movements used as sensors 22, 24 and 26 of a preferred embodiment actually measure the time-derivative of rotational acceleration about bearing axis 122. Other types of sensors could be employed to provide buffered output data signal on line 118 having a range between hexadecimal 00" and hexadecimal "FF" and related to rotational or linear movement, acceleration, or time derivative of acceleration. Other types of A/D converters could also be used as there is no requirement that the buffered output data signal on line 118 have a range between hexadecimal "00" and hexadecimal "FF". Other sensors are available which are capable of measuring the time derivative of changes in position (velocity), the time derivative of velocity (acceleration), and the time derivative of acceleration. Such sensors are available to measure such linear quantities along axes as well as such rotational quantities about axes. Gyroscopes, rate gyroscopes, and other commonly available devices which generate motion signals responsive to movement may be employed in the general manner indicated herein.

Referring to FIG. 1, in a preferred embodiment of the present invention, buffered output data signal on line 118 is transmitted to and processed by processor means 130 in order to convert buffered output data signal on line 118 into control signals on line 126 which are sent to electronic musical instrument 128 to control it. In a preferred embodiment, processor means 130 includes a microprocessor incorporating a 4 MHz Zilog Z-80-A microprocessor chip. It performs signal processing on buffered output data signal on line 118 received by processor means 130 through conventional data reception means, such as UART 132 and generates control signals on line 126 to control musical and other instruments via interface means such as UART 134.

Processor means 130 selects, in a conventional manner well known to those skilled in the art, one of the three channels of data available from A/D converter 56 by transmitting data-in signals on line 80. Motion signals in digital format responsive to one of the sensors 22, 24 or 26 are then transmitted over buffered output data signal line 118 to processor means 130 via UART 132 in a conventional manner well known to those skilled in the art. In a preferred embodiment, UART 134 conforms to the MIDI Musical Instrument Digital Interface Specification 1.0. Control signals for the control of musical and other instruments are transmitted to electronic musical instrument 128 via line 126 (which corresponds in a preferred embodiment to a "MIDI-OUT" port) from UART 134. Those skilled in the art will realize that many other types of electronic interfaces could be used in place of the MIDI-type of interface means described in the MIDI Musical Instrument Digital Interface Specification 1.0 without departing from the invention herein.

Processor means 130 includes clock signal generation means, memory means, and is under the control of software means. This software performs the operations disclosed herein in a standard manner and could be easily constructed by one of ordinary skill in the art. Processor means 130 is configured as well known in the art and thus is not disclosed further herein. Those skilled in the art will realize that many other configurations of processor means are possible. Similarly, the software means which controls processor means 130 is well known in the art, hence further disclosure of much of the software means is not contained herein.

Signal Processing

A preferred embodiment of the present invention provides control signals for control of an electronic musical instrument. In a preferred embodiment, control signals on line 126 consist of signals conforming to the MIDI Musical Instrument Digital Interface Specification 1.0, incorporated by reference above. These control signals on line 126 are generated by processor means 130 and UART 134 in response to the detection of trigger events on buffered output data signal line 118. As described above, buffered data signal line 118 may carry a stream of 8-bit digital signals responsive to at least one of the three sensors 22, 24 and 26.

An important function of the processor means 130 is the detection of trigger events on the three channels of signals responsive to sensors 22, 24 and 26. Processor means 130 include software for controlling the functions of processor means 130 as disclosed below.

The software includes an interrupt driven real time operating system, as might be commonly available and is well known in the art, and signal processing software means as described herein.

In a preferred embodiment, trigger signals responsive to motion events of sensors 22, 24 and 26 are desired for conversion into control signals on line 126 for control of the electronic musical instrument. Processor means 130 under control of software means take a stream of digital data from buffered output data signal on line 118 received via UART 132 and separates that signal into two data streams corresponding to each sensor. As the process is the same for each channel available in the preferred embodiment, the process will be described in detail following the example of the x-sensor 22. As should be clear to one of ordinary skill in the art, the operation of y-sensor 24 and z-sensor 26 is similar to that of x-sensor 22.

The two data streams are formed from the digital data from x-axis sensor obtained by processor means 130 from buffered output data signal on line 118 available, as shown in FIG. 5 at software node 200. The data stream available at software node 200 is passed to non-inverted trigger generator 202 via path 204. A second data stream is formed by inverting the data stream available at software node 200 with inverter 206 and then passing that data stream to inverted trigger generator 208 over software path 210. In the manner herein described, separate trigger events can be detected and converted into control signals on line 126 for events consisting of right-rotational time-derivative of acceleration and left-rotational time-derivative of acceleration impulses detected by x-axis sensor 22. In this manner, six control signals are generated from three sensors used in a preferred embodiment.

Figure 4:
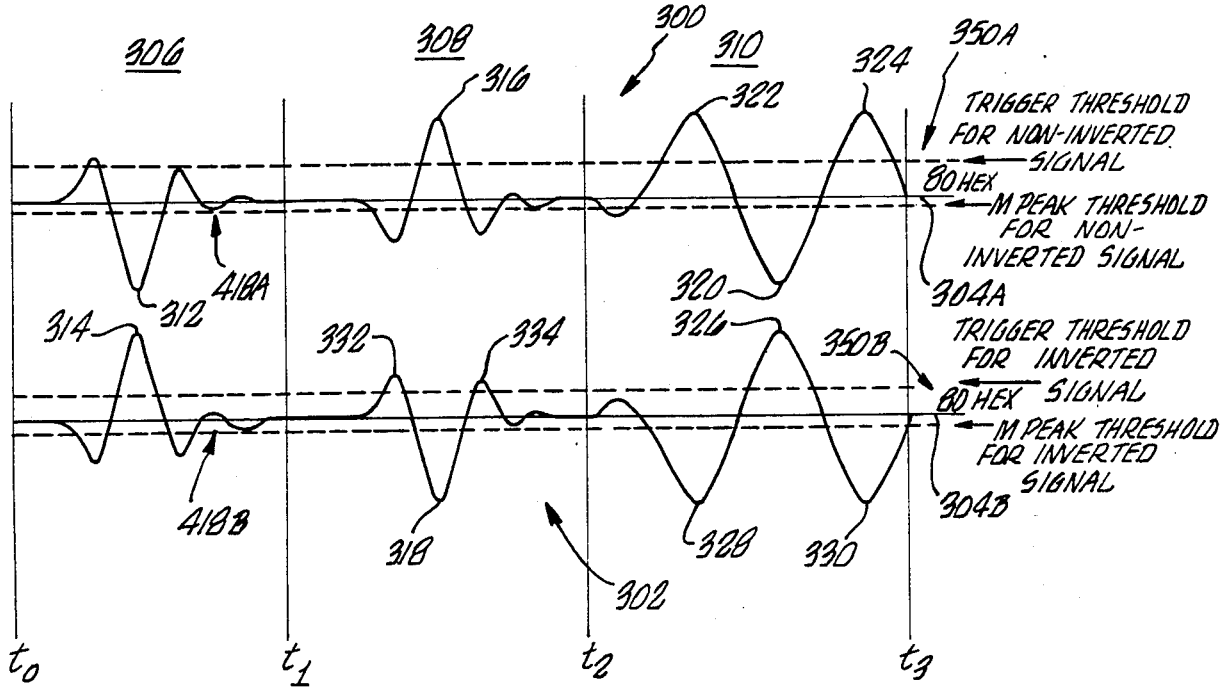
FIG. 4 is a timing diagram illustrative of signals generated by the sensor of FIG. 3.

FIG. 4 illustrates a trace and an inverted trace of a typical simulated motion signal from x-axis sensor 22 undergoing shaking about its axis of rotation. The signal 300 represents a non-inverted signal, while the inverted signal 302 represents an inverted version of signal 300. The center-lines 304A–B represent the value of the output of the sensor in a steady state (e.g. rest state) of "80" hexadecimal. The maximum and minimum values are "FF" hexadecimal and "00" hexadecimal, respectively.

Three types of events depicted in zones 306, 308 and 310 are shown. Zone 306 represents the traces from time t0 to time t1. Zone 308 represents the traces from time t1 to time t2. Zone 310 represents the traces from time t2 to time t3.

In zone 306 a left rotational peak in the motion signals from x-axis sensor 22 has occurred. This is reflected by a significant relative minimum in signal 300 at point 312. Inverted signal 302 shows a relative maximum at corresponding point 314. In a preferred embodiment it is desirable to generate a control signal to electronic musical instrument 128 upon the occurrence of such a relative maximum as shown at point 314 on the channel corresponding to inverted signal 302. To accomplish this, software trigger generator 208 causes an appropriate control signal to be transmitted to the electronic musical instrument 128. Similarly, in zone 308 a right rotational peak in the motion signals from x-axis sensor 22 has occurred. This is reflected by the relative maximum 316 in signal 300 and corresponding relative minimum 318 in signal 302. In this case it is desirable to generate a control signal over the channel corresponding to signal 300. Software trigger generator 202 causes an appropriate control signal to be transmitted to the electronic musical instrument 128. In zone 310 both left rotational peaks 320 and right rotational peaks 322 and 324 are noted on the signal 300 with corresponding points 326, 328 and 330, respectively on inverted signal 302. Software trigger generators 208 and 202 cause processor means 130 to generate appropriate control signals to electronic musical instrument 128 via UART 134.

Peak detection may be of the absolute reference variety, e.g., wait until a signal of a certain minimum or maximum value is detected to identify a peak, or of a more complex nature. Although those skilled in the art will realize that many schemes for peak detection are possible, the one used in a preferred embodiment is described as follows.

Figure 6:
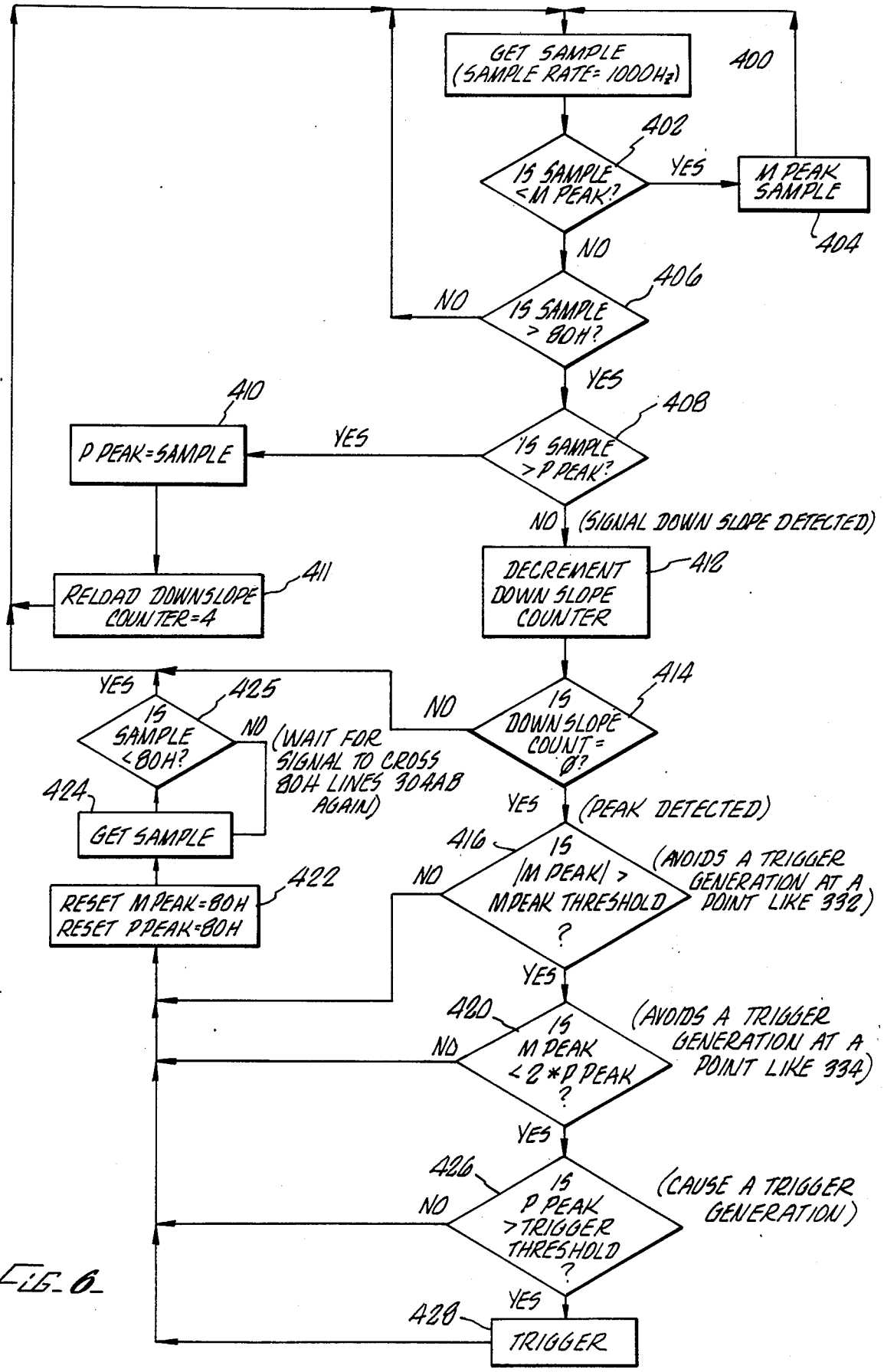
FIG. 6 is a flow chart of a portion of the software used for signal processing.

As shown in FIG. 6, a one byte sample is obtained at software location 400 (hereinafter referred to as SAMPLE). The sample rate is set at 1000 samples per second (1000 Hz). Variable MPEAK is established and is set to the value of the smallest sample detected since MPEAK was last reset. Variable PPEAK is established and is set to the value of the largest SAMPLE detected since PPEAK was last reset. On initialization and on reset, MPEAK and PPEAK are set to a value of "80" hexadecimal. At location 402 SAMPLE is compared to MPEAK. If SAMPLE is less than MPEAK then MPEAK is set to the value of SAMPLE at location 404 and control is transferred to location 400. If SAMPLE is not less than MPEAK, SAMPLE is compared to the absolute value of "80" hexadecimal (sometimes referred to herein as 80H) at location 406. If SAMPLE is not greater than 80H, control is transferred to location 400. If sample is greater than 80H then SAMPLE is compared to PPEAK at location 408. If SAMPLE is greater than PPEAK, PPEAK is set to the new value of SAMPLE at location 410 and a downslope counter is then set to the value of 4 at location 411. Control is then transferred to location 400. If SAMPLE is not greater than PPEAK, a downslope has been detected in the signal, e.g., the prior SAMPLE was of a greater value than the present SAMPLE and the present SAMPLE is greater than the steady state output of 80H. Upon this condition, control transfers to location 412 where the downslope counter is decremented by one unit. At location 414 the downslope counter is compared to zero. If the downslope counter is equal to zero, four successive downslope conditions have been encountered and therefore a peak has been detected under the criteria for this particular embodiment, causing control to transfer to location 416. If the downslope counter is not equal to zero, control transfers to location 400. At location 416 the absolute value of MPEAK is compared to the MPEAK threshold value indicated on FIG. 4 as 418A–B. If the absolute value of MPEAK is greater than the MPEAK threshold value then control is transferred to location 420. Otherwise, control transfers at location 422 where MPEAK and PPEAK are both set to the value of 80H and then to the loop at locations 424 and 425 where a number of SAMPLEs may be retreived in order to get to the next point in the data where there is a crossing of the 80H value. Control is then transferred to location 400. At location 420, the absolute value of MPEAK is compared to two times the value of PPEAK. If the absolute value of MPEAK is less than two times the value of PPEAK, then control is transfered to location 426; otherwise control is transferred to location 422. At location 426, PPEAK is compared to the trigger threshold 350A–B (shown on FIG. 4). If PPEAK exceeds the trigger threshold 350, then a trigger is generated at location 426 and control is transferred to location 422.

Thus a novel apparatus for controlling an electronic musical instrument has been disclosed. While embodiments and applications of this invention have been shown and described, it would be apparent to those skilled in the art that many more modifications are possible without departing from the inventive concepts herein. The invention, therefore, is not restricted to the exact specification above.

I claim:

1. A device capable of controlling an electronic musical instrument, comprising:

a freely moveable control unit;

at least one sensor means responsive to the rotational acceleration of said control unit about one axis for generating motion signals;

said sensor means being substantially non-responsive to linear acceleration;

said sensor means comprising a rotational accelerometer;

processor means, responsive to said motion signals, for generating control signals to control the electronic musical instrument; and means for transmitting said control signals to the electronic musical instrument.

2. A device as in claim 1 including a plurality of said sensor means.

3. A device as in claim 1 including three said sensor means.

4. A device as in claim 2, wherein said plurality of said sensor means measure rotational acceleration about substantially orthogonal axes.

5. A device as in claim 3, wherein said three said sensor means measure rotational acceleration about three substantially orthogonal axes.

6. A device as in claim 1, wherein said control unit is capable of being hand-held.

7. A device as in claim 1, wherein said control unit is mounted in a substantially cylindrical housing.

8. A device as in claim 7, wherein said housing is capable of being hand-held.

9. A device capable of controlling an electronic musical instrument, comprising:

a freely moveable control unit;

at least one sensor means responsive to the time-derivative of rotational acceleration of said control unit about one axis for generating motion signals;

said sensor means being substantially non-responsive to linear acceleration;

said sensor means including a moving coil, a permanent magnet, a bearing axis and a biasing means;

said moving coil arranged so as to be capable of rotation on said bearing axis and about said permanent magnet;

said biasing means mounted coaxial with said bearing axis and capable of biasing said moving coil toward a rest position about said bearing axis;

processor means, responsive to said motion signals, for generating control signals to control the electronic musical instrument; and means for transmitting said control signals to the electronic musical instrument.

10. A device as in claim 9 including a plurality of said sensor means.

11. A device as in claim 10, wherein said plurality of said sensor means measure the time-derivative of rotational acceleration about substantially orthogonal axes.

12. A device as in claim 9 wherein said sensor means is a meter movement.

13. A device capable of controlling an electronic musical instrument, comprising:

a freely moveable control unit;

at least one sensor means capable of generating a first signal;

said first signal corresponding to the time-derivative of rotational acceleration of said control unit about a preselected axis;

said sensor means being substantially non-responsive to linear acceleration;

processor means, responsive to said first signal, for generating a second signal to control the electronic musical instrument; and means for transmitting said second signal to the electronic musical instrument.

14. A device as in claim 13 wherein said first signal is a motion signal and said second signal is a control signal.

15. A device as in claim 13 including a plurality of said sensor means.

16. A device as in claim 13 including three said sensor means.

17. A device as in claim 14 wherein said plurality of said sensor means measure the time-derivative of rotational acceleration about substantially orthogonal axes.

18. A device capable of controlling an electronic musical instrument, comprising:

a freely moveable control unit;

at least one sensor means capable of generating a first signal;

said sensor means including a moving coil, a permanent magnet, a bearing axis and a biasing means;

said moving coil arranged so as to be capable of rotation on said bearing axis and about said permanent magnet;

said biasing means mounted coaxial with said bearing axis and capable of biasing said moving coil toward a rest position about said bearing axis;

said first signal corresponding to the time-derivative of rotational acceleration of said control unit about a preselected axis;

processor means, responsive to said first signal, for generating a second signal to control the electronic musical instrument; and means for transmitting said second signal to the electronic musical instrument.

19. A device as in claim 18 wherein said first signal is a motion signal and said second signal is a control signal.

20. A device as in claim 18 including a plurality of said sensor means.

21. A device as in claim 18 including three said sensor means.

22. A device as in claim 20 wherein said plurality of said sensor means measure the time-derivative of rotational acceleration about substantially orthogonal axes.

23. A device capable of controlling an electronic musical instrument, comprising:

a freely moveable control unit;

at least one sensor means responsive to the time-derivative of rotational acceleration of said control unit about an axis for generating motion signals;

said sensor means including a moving coil, a permanent magnet, a bearing axis and a biasing means;

said moving coil arranged so as to be capable of rotation on said bearing axis and about said permanent magnet;

said biasing means mounted coaxial with said bearing axis and capable of biasing said moving coil toward a rest position about said bearing axis;

said motion signals corresponding to the time-derivative of rotational acceleration of said control unit about said axis of said control unit;

processor means, responsive to said motion signals, for generating control signals to control the electronic musical instrument; and means for transmitting said control signals to the electronic musical instrument.

24. A device as in claim 23 including a plurality of said sensor means.

25. A device as in claim 23 including three said sensor means.

26. A device as in claim 24 wherein said plurality of said sensor means measure the time-derivative of rotational acceleration about substantially orthogonal axes.

27. A device as in claim 25 wherein said three said sensor means measure the time-derivative of rotational acceleration about three substantially orthogonal axes.

28. A device for providing an electronic musical instrument with control signals corresponding to peaks in the right-rotational time-derivative of acceleration and left-rotational time-derivative of acceleration of a freely moveable and hand holdable control unit about an axis comprising:

at least one sensor means responsive to the time-derivative of rotational acceleration of the control unit about the axis for generating motion signals;

said sensor means including a moving coil, a permanent magnet, a bearing axis and a biasing means;

said moving coil arranged so as to be capable of rotation on said bearing axis and about said permanent magnet;

said biasing means mounted coaxial with said bearing axis and capable of biasing said moving coil toward a rest position about said bearing axis;

processor means, responsive to said motion signals, for generating control signals to control the electronic musical instrument;

means for transmitting said control signals to the electronic musical instrument.

29. A device as in claim 28 wherein said control signals comprise first and second control signals.

30. A device as in claim 29 wherein said first control signal corresponds to peaks in the right-rotational time-derivative of rotational acceleration of the control unit about the axis and said second control signal corresponds to peaks in the left-rotational time derivative of rotational acceleration of the control unit about the axis.

31. A device capable of controlling an electronic musical instrument, comprising:

a control unit;

at least one sensor means responsive to the position of said control unit about a predetermined axis;

said sensor means including a bearing axis, a biasing means, a measuring means, and a mass;

said mass mounted on said bearing axis;

said mass disposed so as to be capable of rotation about said bearing axis;

said biasing means disposed so as to bias said mass to a rest position about said bearing axis;

said measuring means capable of generating motion signals corresponding to the position of said mass about said predetermined axis;

processor means, responsive to said motion signals, for generating control signals to control the electronic musical instrument; and means for transmitting said control signals to the electronic musical instrument.

32. A device as in claim 31 wherein said measuring means includes a hall effect sensor.

33. A device capable of controlling an electronic musical instrument, comprising:

a control unit;

at least one sensor means responsive to the rotational velocity of said control unit about a predetermined axis;

said sensor means including a bearing axis, a biasing means, a measuring means, and a mass;

said mass mounted on said bearing axis;

said mass disposed so as to be capable of rotation about said bearing axis;

said biasing means disposed so as to bias said mass to a rest position about said bearing axis;

said measuring means capable of generating motion signals corresponding to the rotational velocity of said mass about said predetermined axis;

processor means, responsive to said motion signals, for generating control signals to control the electronic musical instrument; and means for transmitting said control signals to the electronic musical instrument.

34. A device capable of controlling an electronic musical instrument, comprising:

a control unit;

at least one sensor means responsive to the rotational acceleration of said control unit about a predetermined axis;

said sensor means including a bearing axis, a biasing means, a measuring means, and a mass;

said mass mounted on said bearing axis;

said mass disposed so as to be capable of rotation about said bearing axis;

said biasing means disposed so as to bias said mass to a rest position about said bearing axis;

said measuring means capable of generating motion signals corresponding to the rotational acceleration of said mass about said predetermined axis;

processor means, responsive to said motion signals, for generating control signals to control the electronic musical instrument; and means for transmitting said control signals to the electronic musical instrument.

35. A device capable of controlling an electronic musical instrument, comprising:

a control unit;

at least one sensor means responsive to the time-derivative of rotational acceleration of said control unit about a predetermined axis;

said sensor means including a bearing axis, a biasing means a measuring means, and a mass;

said mass mounted on said bearing axis;

said mass disposed so as to be capable of rotation about said bearing axis;

said biasing means disposed so as to bias said mass to a rest position about said bearing axis;

said measuring means capable of generating motion signals corresponding to the time-derivative of rotational acceleration of said mass about said predetermined axis;

processor means, responsive to said motion signals, for generating control signals to control the electronic musical instrument; and means for transmitting said control signals to the electronic musical instrument.

36. A device as in claim 35 wherein said measuring means includes a moving coil and said mass is a permanent magnet.

* * * * *